US010391376B2

(12) United States Patent
Guise

(10) Patent No.: US 10,391,376 B2
(45) Date of Patent: Aug. 27, 2019

(54) STICKHANDLING TOOLS, HOCKEY TRAINING AIDS, AND RELATED METHODS

(71) Applicant: Darcy Guise, Beaverlodge (CA)

(72) Inventor: Darcy Guise, Beaverlodge (CA)

( * ) Notice: Subject to any disclaimer, the term of this patent is extended or adjusted under 35 U.S.C. 154(b) by 0 days.

(21) Appl. No.: 15/495,965

(22) Filed: Apr. 24, 2017

(65) Prior Publication Data

US 2017/0319932 A1 Nov. 9, 2017

Related U.S. Application Data

(60) Provisional application No. 62/361,958, filed on Jul. 13, 2016.

(30) Foreign Application Priority Data

Apr. 22, 2016 (CA) ..... 2927789

(51) Int. Cl.

| | |
|---|---|
| ***A63B 59/00*** | (2015.01) |
| ***A63B 59/12*** | (2006.01) |
| ***A63B 59/14*** | (2006.01) |
| ***A63B 69/00*** | (2006.01) |
| ***A63B 59/70*** | (2015.01) |
| ***A63B 59/20*** | (2015.01) |
| *A63B 102/24* | (2015.01) |
| *A63B 102/22* | (2015.01) |

(52) U.S. Cl.

CPC ..... *A63B 69/0026* (2013.01); *A63B 59/20* (2015.10); *A63B 59/70* (2015.10); *A63B 69/0024* (2013.01); *A63B 2102/22* (2015.10); *A63B 2102/24* (2015.10); *A63B 2225/09* (2013.01)

(58) Field of Classification Search

CPC . A63B 69/0026; A63B 59/70; A63B 2102/22; A63B 2102/24; A63B 2225/09

USPC ..... 473/560–563, 446, 437, 328, 235, 228, 473/518–520, 594; D21/727

See application file for complete search history.

(56) References Cited

U.S. PATENT DOCUMENTS

| | | | | | |
|---|---|---|---|---|---|
| 682,807 | A * | 9/1901 | Minor | A63B 59/70 | 473/563 |
| 2,072,682 | A * | 3/1937 | Morgan | A63B 67/002 | 473/515 |
| 3,720,410 | A * | 3/1973 | Saytar | A63B 59/70 | 473/562 |
| 3,809,401 | A * | 5/1974 | Hankele | A63B 59/70 | 473/560 |
| 3,844,555 | A * | 10/1974 | Tremblay | A63B 59/00 | 473/563 |
| D244,790 | S * | 6/1977 | Carlson | 473/563 | |
| 4,340,214 | A * | 7/1982 | Schutzer | A63B 22/203 | 482/123 |

(Continued)

FOREIGN PATENT DOCUMENTS

| | | | | |
|---|---|---|---|---|
| CA | 1305731 | | 7/1992 | |
| EP | 0285456 | A2 * | 10/1988 | A63B 59/70 |
| WO | WO 9421334 | A1 * | 9/1994 | A63B 59/70 |

*Primary Examiner* — Mitra Aryanpour

(74) *Attorney, Agent, or Firm* — Robert A. Nissen

(57) ABSTRACT

A stickhandling tool has a first hockey stick blade, a second hockey stick blade, and a structural part with a cross member that connects to and laterally separates the first hockey stick blade and the second hockey stick blade to define a ball or puck receiving cavity between the first hockey stick blade and the second hockey stick blade.

15 Claims, 13 Drawing Sheets

(56) References Cited

U.S. PATENT DOCUMENTS 4,340,224 A * 7/1982 Staats ..... A63B 59/70 473/563
4,343,468 A * 8/1982 Lindgren ..... A63B 59/70 473/563
4,452,451 A * 6/1984 Dubreuil ..... A63B 59/70 473/563
4,653,753 A 3/1987 Scarry
4,741,371 A * 5/1988 Lord ..... B27M 3/22 144/269
4,779,862 A * 10/1988 Keppler ..... A63B 69/0022 482/51
4,940,226 A * 7/1990 Carra ..... A63B 69/0022 434/253
5,076,571 A * 12/1991 Croce, Jr. ..... A63B 69/0022 472/90
5,078,396 A * 1/1992 Cavallaro ..... A63B 59/70 473/561
5,114,387 A * 5/1992 Keppler ..... A63B 21/4037 434/253
5,133,700 A * 7/1992 Braathen ..... A63B 69/0022 472/118
5,393,282 A * 2/1995 Maclean ..... A63B 69/0022 482/51
5,980,404 A * 11/1999 Gentile ..... A63B 69/0024 473/560
6,273,835 B1 * 8/2001 Battis ..... A63B 59/70 473/563
6,926,629 B2 * 8/2005 Dehen ..... A47L 13/00 473/563
7,410,432 B2 * 8/2008 Dehen ..... A47L 13/00 473/560
7,841,959 B2 * 11/2010 Bremner ..... A63B 69/0026 473/446
8,231,486 B2 * 7/2012 Neufeld ..... A63B 59/70 473/563
2006/0270497 A1 * 11/2006 Dehen ..... A47L 13/00 473/563
2008/0287224 A1 11/2008 Salvador et al.
2009/0264229 A1 * 10/2009 Forsberg ..... A63B 67/002 473/563
2012/0058843 A1 * 3/2012 Neufeld ..... A63B 59/70 473/563
2012/0083370 A1 * 4/2012 Girsky ..... A63B 59/70 473/563
2014/0094329 A1 * 4/2014 Taylor ..... A63B 69/0026 473/563
2014/0171237 A1 6/2014 Crossley
2014/0349785 A1 11/2014 Henning
2015/0057110 A1 2/2015 Smith

* cited by examiner

STICKHANDLING TOOLS, HOCKEY TRAINING AIDS, AND RELATED METHODS

TECHNICAL FIELD

This document relates to stickhandling tools, training aids, and related methods of use.

BACKGROUND

Training aids for stickhandling include pucks tethered by a strap to a hockey blade, devices that mount to the blade to obscure a player's view of the blade, devices that mount to the blade to increase the weight of the blade, and various obstacles that can be arranged on an ice surface in different configurations.

SUMMARY

A stickhandling tool is disclosed comprising: a first hockey stick blade; a second hockey stick blade; and a structural part with a cross member that connects to and laterally separates the first hockey stick blade and the second hockey stick blade to define a ball or puck receiving cavity between the first hockey stick blade and the second hockey stick blade.

A method is disclosed comprising stickhandling a ball or puck in a ball or puck receiving cavity defined between a first hockey stick blade and a second hockey stick blade, with a structural cross member extending between the first hockey stick blade and the second hockey stick blade.

An apparatus is disclosed comprising: a structural part having a first part and a second part; the first part comprising, or being adapted to connect to, a first hockey stick blade; the second part comprising, or being adapted to connect to, a second hockey stick blade; such that, in use, the first hockey stick blade and the first hockey stick blade are laterally spaced by the structural member to define a ball or puck receiving cavity.

A training aid for stickhandling with a sport implement (such as a hockey stick or hockey stick blade) is disclosed comprising: a mount for securing to the sport implement; a post extending laterally from the mount; and a training blade, connected to the post and spaced laterally from the sport implement.

In various embodiments, there may be included any one or more of the following features. The first hockey stick blade forms part of a hockey stick with a shaft extended from the first hockey stick blade. The structural part further comprises a shaft, heel, or ankle connector that secures the hockey stick to the structural part. The shaft, heel, or ankle connector comprises a collar encircling one or more of the shaft of the hockey stick, a heel part of the first hockey stick blade, or an ankle part of the first hockey stick blade. The shaft, heel, or ankle connector comprises a clamp. The clamp comprises a camlock. The structural part further comprises a toe connector that secures a toe of the first hockey stick blade to the structural part. The toe connector comprises a toe receiving cup. The toe connector and the shaft, heel, or ankle connector collectively form part of a blade retainer that extends between the toe connector and the shaft, heel, or ankle connector. The structural part forms a blade retainer that extends between a toe part and a heel part of the first hockey stick blade. The blade retainer comprises a blade sheath. The cross member forms a ball or puck fence that defines a rear end of the ball or puck receiving cavity. The cross member further comprises a first cross member and a second cross member, the first cross member being located closer to a toe end of the stickhandling tool than the second cross member. The first cross member forms a front ball or puck fence that defines a front end of the ball or puck receiving cavity; and the second cross member forms a rear ball or puck fence that defines a rear end of the ball or puck receiving cavity. The first cross member extends between respective toe parts of the first hockey stick blade and the second hockey stick blade; and the second cross member extends between respective heel or ankle parts of the first hockey stick blade and the second hockey stick blade. The cross member further comprises a third cross member extended between respective heel or ankle parts of the first hockey stick blade and the second hockey stick blade. The cross member comprises a lateral rod. The cross member is connected to the first hockey stick blade and the second hockey stick blade by respective threaded connections. The structural part is structured to vary a lateral separation distance between the first hockey stick blade and the second hockey stick blade. The structural part further comprises a connector that is adapted to permit the second hockey stick blade to be secured: on a right side of the first hockey stick blade in a first configuration; and on a left side of the first hockey stick blade in a second configuration. A combination of a stickhandling tool positioned on an ice surface with a puck positioned within the ball or puck receiving cavity. The parts of a stickhandling tool forming a kit. A series of interchangeable cross members of different lengths with respect to one another for varying a lateral width of the ball or puck receiving cavity.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Hockey is a family of sports in which two teams play against each other by trying to maneuver a ball or a puck into the opponent's goal using a hockey stick. The most commonly played versions of hockey in North America are ice hockey and field hockey. Some other forms of hockey include roller hockey, bandy, ball hockey, and sledge hockey.

Ice hockey is played between two teams of skaters on a large flat area of ice, using a vulcanized rubber disc called a puck. The game is played all over North America, Europe and to varying extents in many other countries around the world. Ice hockey sticks are long L-shaped sticks made of a suitable material such as wood, aluminum, aramid (KEVLAR™), fiberglass, carbon fiber, and other composite materials. Such sticks have a blade extended at the base or taper of the stick shaft. The blade generally lies flat on the playing surface when the stick is held upright and may curve left or right depending on the preference of the player.

Field hockey is played on gravel, natural grass, or sand-based or water-based artificial turf, with a small, hard, ball. Field hockey is popular among both males and females in many parts of the world, particularly in Europe, Asia, Australia, New Zealand, South Africa, and Argentina. Modern field hockey sticks may be constructed of a suitable material such as a composite of wood, glass fiber or carbon fiber. Such sticks may be J-shaped, with a curved hook or blade at the playing end of a shaft. The hook may have a flat surface on a playing face and a curved surface on a back face.

All forms of hockey demand skill in the art of stickhandling—the ability to skate or move across the playing surface while maneuvering and controlling the puck or ball using the blade of the hockey stick. Hockey players of all ages typically practice such a skill with drills and training aids. Effective stickhandling involves a complex form of multitasking—the player must simultaneously exercise a) control of the puck, b) control of the movement of the player's body, c) awareness of surrounding players and objects, and d) strategic advancement of the game in favor of the player's team. Stickhandling is a challenge for all ages and skill levels of players, but particularly for younger players, who have a strong tendency to watch the puck while stickhandling, or to neglect one or more of the other core tasks to be carried out simultaneously while stickhandling during play.

Figure 1:
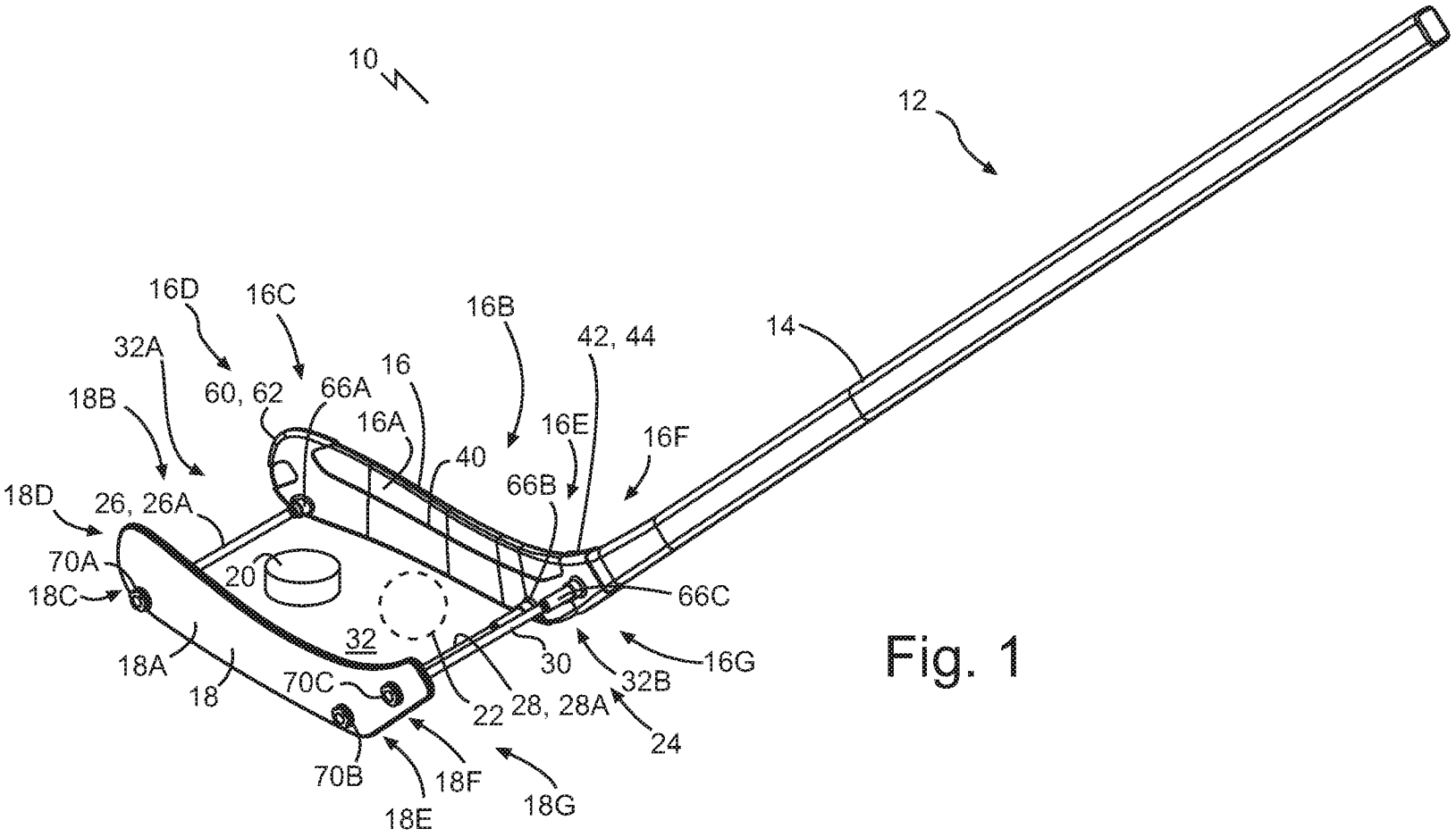
FIG. 1 is a perspective view of a stickhandling tool in use with a hockey stick and puck, and a ball shown in dashed lines.
Figure 3:
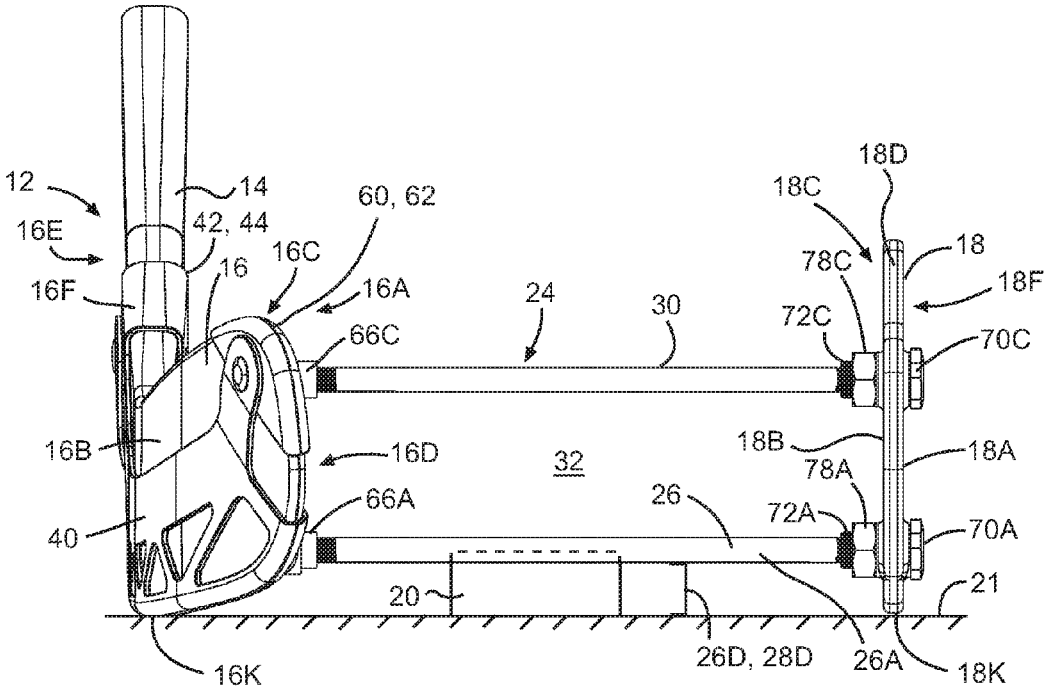
FIG. 3 is a front end view of the stickhandling tool of FIG. 1 in use on an ice surface.

Referring to FIGS. 1 and 3, a stickhandling tool 10 is illustrated having a first hockey stick blade 16, a second hockey stick blade 18 and a structural part 24. Structural part 24 may comprise a cross member 26. Cross member 26 may connect and laterally separate the first hockey stick blade 16 and the second hockey stick blade 18 to define a ball or puck receiving cavity 32 between the first and second hockey stick blades 16 and 18, respectively, in use.

The stickhandling tool 10 may be structured to incorporate or attach to a hockey stick. For example, first hockey stick blade 16 is shown as forming part of a hockey stick 12, which also has a shaft 14 extended from the first hockey stick blade 16. In such a case a user may assemble tool 10 by connecting the cross member 26 to the blade 16. In some cases the method of assembling the tool 10 includes connecting the cross member 26 to the second blade 18. Retrofitting the unit to a user's existing hockey stick leverages the structure provided by the stick and permits a more natural experience for the user who is presumably familiar with the feel and function of that user's hockey stick.

The tool 10 may be configured for right or left-handed use. Referring to FIG. 1, a first configuration is shown for use with a right-handed hockey stick 12. In the first configuration, a left blade face 16A of the first blade 16, and a right blade face 18B of the second blade 18, may be oriented to face one another to act as puck contacting surfaces that define puck receiving cavity 32 and within which a puck may be passed from face 16A to face 18B during stickhandling. In a second configuration not shown in FIG. 1, the tool 10 may be configured for use with a left-handed hockey stick. In the second configuration, a right blade face 16B of the first blade 16 may be oriented to face a left blade face 18A of the second blade 18 to act as puck contacting surfaces. An example of a tool 10 that connects to a left-handed hockey stick in use is shown in FIG. 14. Other examples of left-handed tools 10 are envisioned, including those shown in the mirror images of FIGS. 1-13 and 15.

Figure 4:
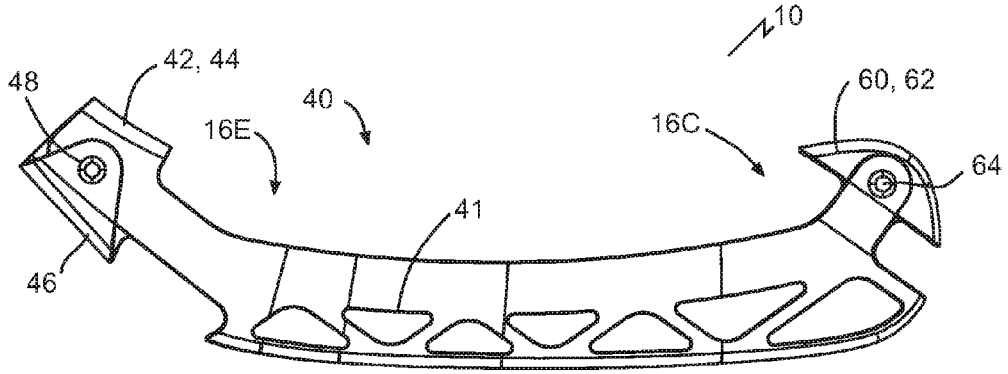
FIG. 4 is a side elevation view of the blade retainer part of the stickhandling tool of FIG. 1.
Figure 5:
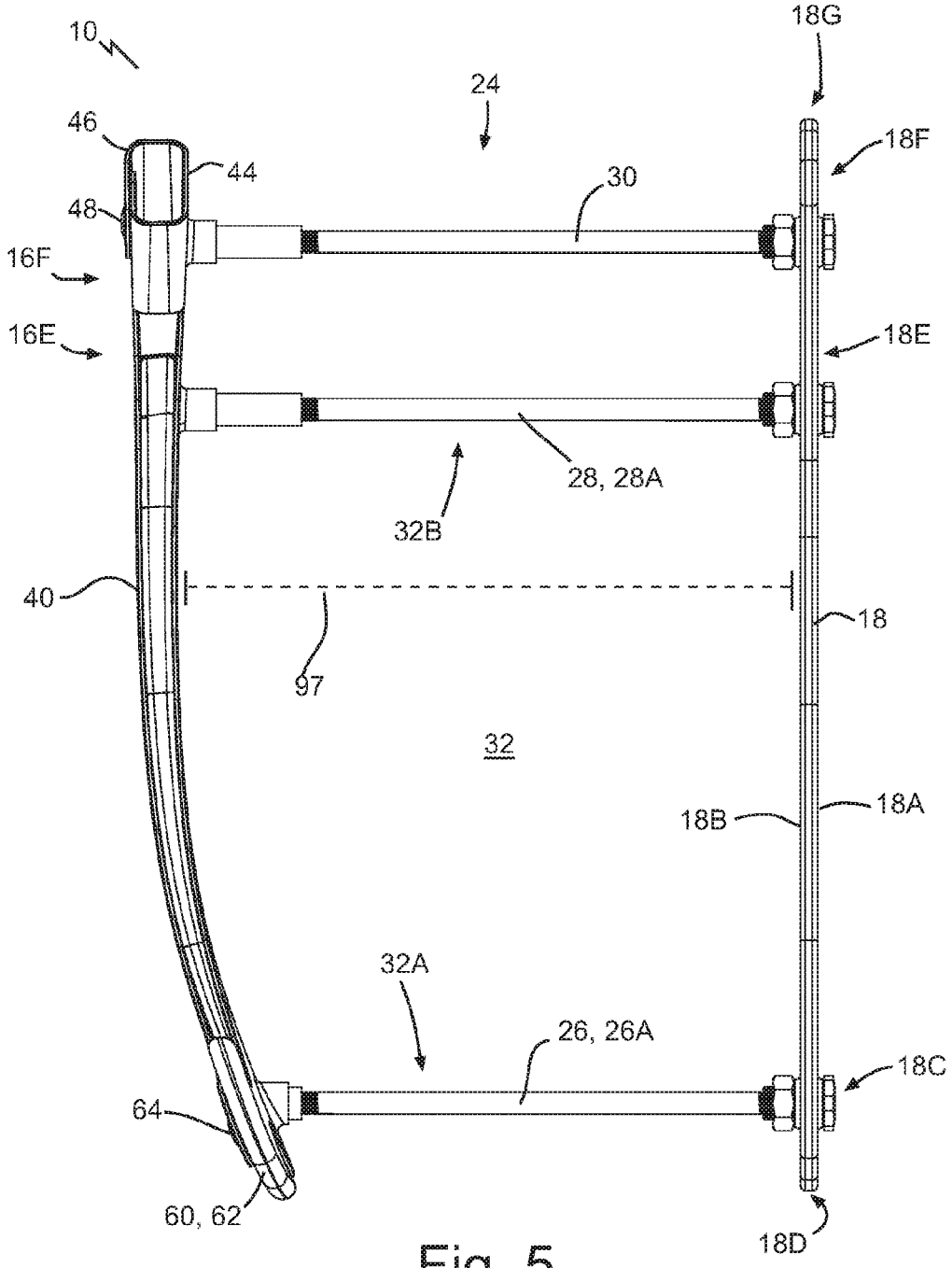
FIG. 5 is a top plan view of the stickhandling tool of FIG. 1.

Referring to FIGS. 1 and 3, structural part 24 may comprise a connector 42 that secures the structural part 24 and second blade 18 to one or more of the shaft, heel, or ankle of the hockey stick 12. Connector 42 may also form part of the hockey stick 12, for example if the cross member 26 is integrally formed with the hockey stick 12. Referring to FIGS. 4 and 5, the shaft, heel, or ankle connector 42 may comprise a collar encircling one or more of the shaft 14, a heel part 16E, or an ankle part 16F of the hockey stick 12. For ease in removal and reattachment, collar may comprise a strap part 46, which may be flexible or resilient, and a fastener 48. During assembly the strap part 46 may be wrapped around the ankle part 16F (taper) of hockey stick 12 and secured with fastener 48, which may be a suitable fastener such as a snap fastener button. Other suitable connectors 42 may be used such as a clamp 44 described below.

Referring to FIG. 1, structural part 24 may comprise a toe connector 60 that secures a toe part 16C of the first hockey stick blade 16 to the structural part 24. Toe connector 60 may be located at or adjacent to the toe end 16D and may or may not cover or contact the toe end 16D. Referring to FIG. 4, toe connector 60 may comprise a suitable mechanism for mounting to the toe part 16C, such as a toe receiving cup 62. Toe connector 60 may further comprise a fastener 64, such as a rivet, for securing cup 62 or connector 60 to the structural part 24. The toe connector 60 may comprise a suitable material such as dense rubber.

Referring to FIGS. 1 and 4, the structural part 24 may form a blade retainer 40, for example that extends between a toe part 16C and a heel part 16E of the first hockey stick blade 16. In one case, toe connector 60 and shaft, heel, or ankle connector 42 collectively forms part of the blade retainer 40, which may extend between the toe connector 60 and the connector 42. Blade retainer 40, which may be a sheath as shown, may run along an axial length of the first hockey blade 16, for example along left and right blade faces 16A and 16B, to provide support for the structural part 24 and second blade 18. In the example shown the blade sheath wraps underneath a lower ice contacting edges or surfaces 16K (FIG. 3) of the blade 16. Blade sheath or retainer 40 may partially or fully cover the first hockey blade 16. Blade retainer 40 may define a plurality of holes or cutouts 41. The blade sheath may fit as a shoe around the blade 16.

The stickhandling tool 10 may form a cage for retaining a ball 22 or puck 20 within the cavity 32 in use. The cross member may comprise one or both of a first cross member 26 and a second cross member 28, and in some embodiments one or both of members 26 and 28 form a fence that defines part of the cage. Referring to FIGS. 1 and 5, cross member 28 is shown forming a ball or puck fence 28A that defines a rear end 32B of the ball or puck receiving cavity 32. Cross member 26 is shown forming a ball or puck fence 26A that defines a front end 32A of the ball or puck receiving cavity 32. First cross member 26 may be located closer to a toe end 16D of stickhandling tool 10 than the second cross member 28. In one case, first cross member 26 extends between respective toe parts 16C and 18C, for example by connection to the toe part 16C of the first hockey stick blade 16 and the toe part 18C of the second hockey stick blade 18. The second cross member 28 may extend between respective heel or ankle parts 16E, 18E, for example by connection to the heel parts 16E, 18E of the first and second blades 16 and 18, respectively. Referring to FIG. 3, the ball or puck receiving cavity 32 may be defined by the first cross member 26, the left face 16A of the first blade 16, the second cross member 28 and the right face 18B of the second blade 18.

The use of front, rear, or front and rear fences 26A and 28A, respectively, permit the puck or ball to be retained and stickhandled within the cavity 32 while the blades 16 and 18 are in contact on an ice, ground, or floor surface 21. A fence is understood to refer to a part that is structured or positioned to form a stop or bumper for a puck or ball sliding or otherwise moving along the surface 21 when the blades 16 and 18 are resting in an upright neutral position shown with ice-contacting surfaces 16K and 18K contacting the surface 21. Thus, in the neutral position a fence will be in contact with surface 21, or will be above but within sufficient proximity to the surface 21 to retain the puck or ball. The front and rear fences 26A and 28A may be raised above the ice surface 21 by a distance 26D and 28D, respectively, such as half of an inch, less than a height of a puck 20. Other distances may be used. Fences may be defined with respect to an ice-contacting plane defined by ice-contacting surfaces 16K and 18K of the blades 16 and 18, and in the example shown also defined by the surface 21.

Referring to FIGS. 1, 3 and 5, the cross member may also comprise a third cross member 30, and in some cases a fourth, a fifth or more cross members (not shown). More than one cross member such as member 30 may be provided for increasing the strength and some cases rigidity of the stickhandling frame formed by the blades 16, 18 and part 24. Third cross member 30 may extend between respective heel parts 16E, 18E or ankle parts 16F, 18F of the first blade 16 and the second blade 18. Cross members may comprise lateral rods, arms or other structural features that connect and space the first blade 16 from the second blade 18.

Figure 2:
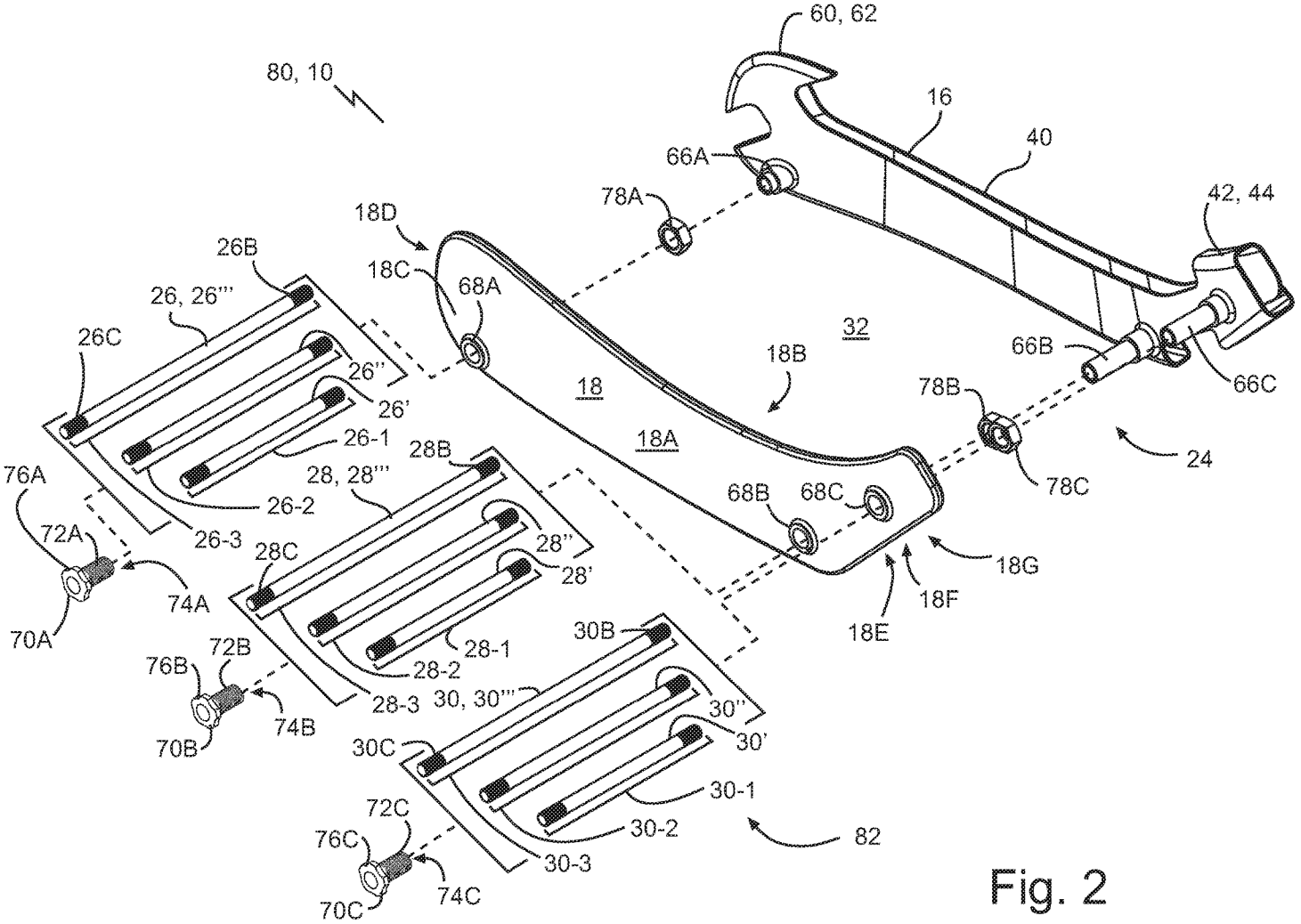
FIG. 2 is an exploded perspective view of a kit for the stickhandling tool of FIG. 1, and including a series of interchangeable cross members of varying lengths for different configurations.

Referring to FIG. 5, the part 24 may be structured to permit variations in a lateral width or separation distance 97 between the first hockey stick blade 16 and the second hockey stick blade 18. Referring to FIG. 2, in the example shown the part 24 may be assembled in a variety of configurations each made using groups of cross members of different lengths to achieve distance 97 variation. Varying the lateral distance 97 may be useful to adapt the tool 10 to users of different size and skill. For example, a user may modify the distance 97 by swapping out first, second, and third cross members 26', 28' and 30' of respective first lengths 26-1, 28-1, and 30-1, with first, second and third cross members 26", 28", 30" of respective second lengths 26-2, 28-2, 30-2, or with first, second and third cross members 26''', 28''', 30''' of respective third lengths 26-3, 28-3, and 30-3. Other suitable mechanisms of providing separation distance variation may be used, such as by providing a telescoping cross member, an accordion style cross member, a scissor connection, or by providing a cross member that slides through or along a connector (FIG. 14).

Referring to FIG. 2, stickhandling tool 10 may be provided in kit 80 form. A kit 80 may include a series 82 of interchangeable cross members 26, 28 and 30 of different lengths with respect to one another for varying the lateral width of the ball or puck receiving cavity 32, for example as discussed above. Series 82 may comprise two, three or more color-coded groups of cross members 26, 28, 30 with different respective lengths. Other indicators may be used to identify the members of a respective group.

Referring to FIGS. 1 and 2, a suitable mechanism may be used to secure cross member 26, 28, and 30 to the part 24 or between blades 16 and 18. Referring to FIG. 2, in the example shown the cross members 26, 28 and 30, each connect to the first and second hockey stick blades 16, 18 by respective threaded connections, for example at threaded ends 26B, 26C, 28B, 28C, and 30B, 30C. First threaded ends 26B, 28B and 30B may be adapted to mate with respective female threaded connectors 66A, 66B and 66C projecting laterally from the blade retainer 40 adjacent first hockey stick blade face 16A. The female threaded connectors 66A, 66B and 66C may be adapted to provide a consistent distance between each of the connectors 66A, B, and C and each of the respective connectors or passages 68A, 68B and 68C, so that each cross members 26, 28, and 30 in a group may have identical length to permit interchangeable connection to any of connectors 66A, B, and C without specificity between connector and cross member. In the example shown connectors 66B and 66C form risers relative to connector 66A to compensate for the effect on lateral separation of blades 16 and 18 caused by the curve of the blade 16.

Referring to FIGS. 1 and 2, first, second and third cross members 26, 28 and 30, may comprise respective second threaded ends 26C, 28C and 30C. Second threaded ends 26C, 28C and 30C may be adapted to mate with the respective female threading 74A, 74B and 74C on respective end bolts 70A, 70B and 70C. End bolts 70A, 70B and 70C may comprise male threading 72A, 72B and 72C for mating with respective cross member passages 68A, 68B and 68C defined by the second hockey stick blade 18, and/or for mating with respective nuts 78A, 78B and 78C to secure the cross members 26, 28, and 30 within respective passages 68A, 68B, and 68C. End bolts 70A, 70B and 70C may comprise finger grooves 76A, 76B, 76C, respectively, to permit finger tightening of the respective end bolt. Other suitable mechanisms of securing the cross members 26, 28, and 30 to the part 24 and blades 16, 18 may be used, such as connections that use fasteners, quick connects, cam locks, straps, loop and hook connectors, and others.

Figure 6:
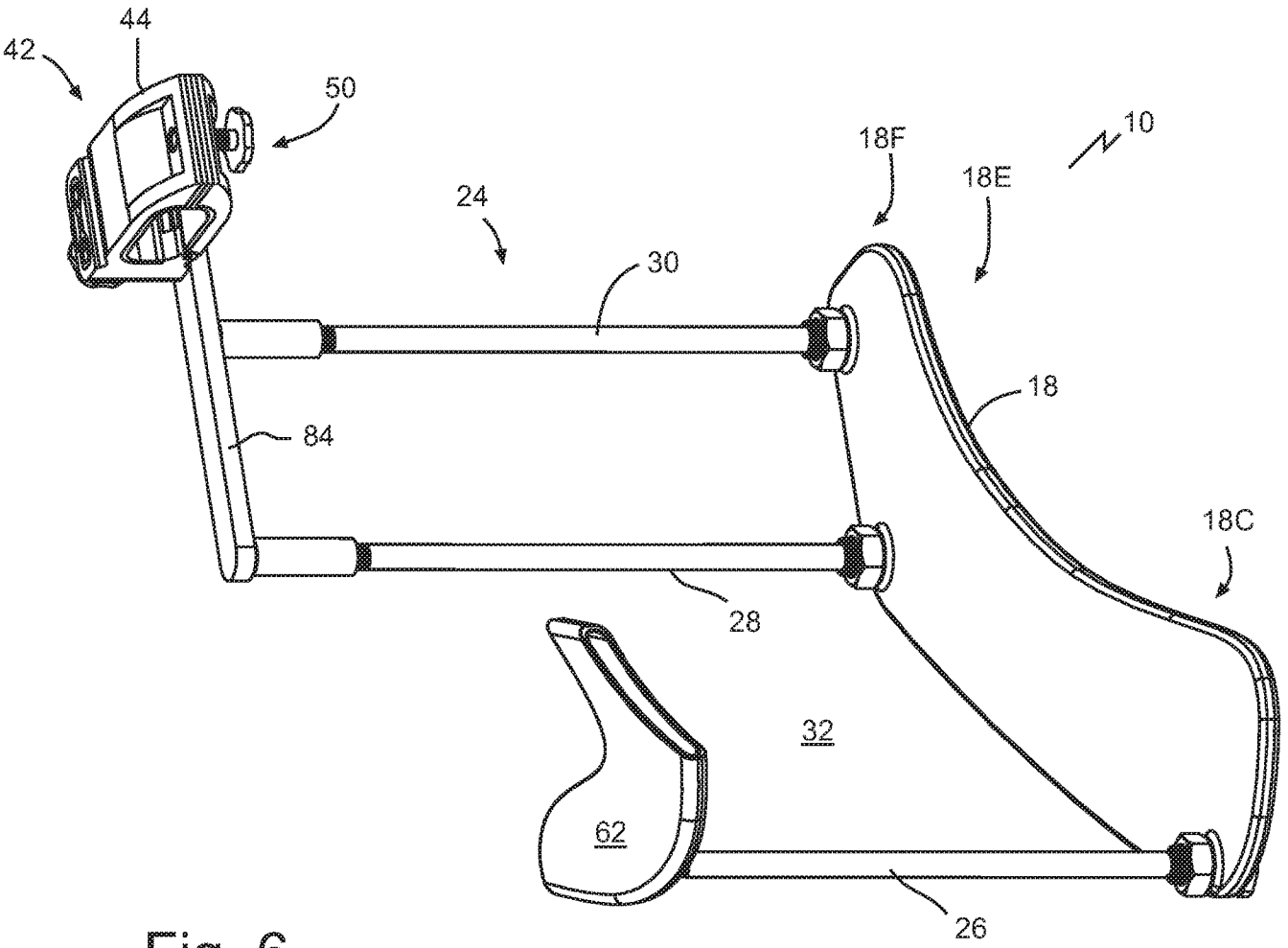
FIG. 6 is a left front perspective view of a further embodiment of a stickhandling tool.
Figure 7:
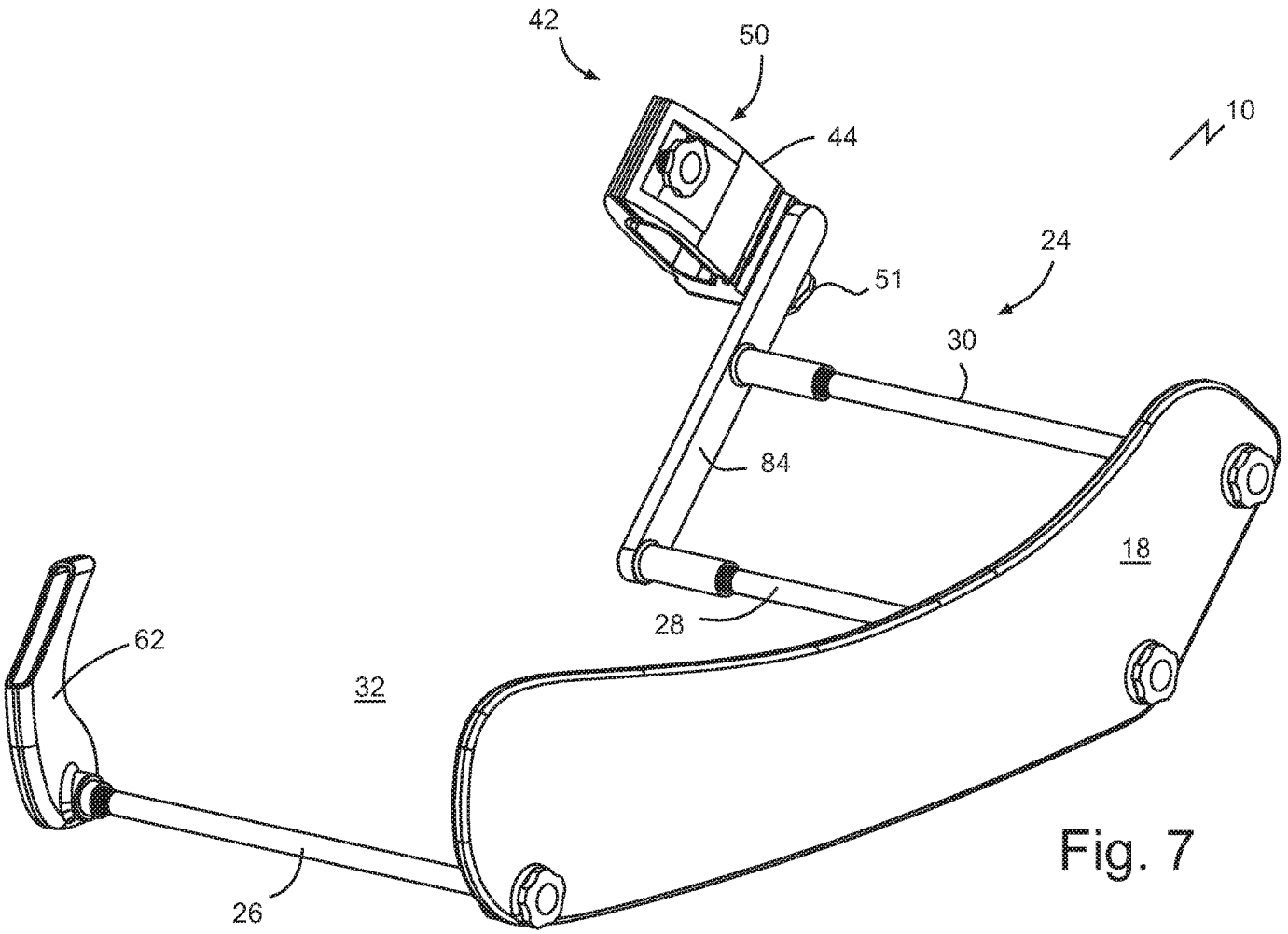
FIG. 7 is a right front perspective view of the stickhandling tool of FIG. 6.
Figure 8:
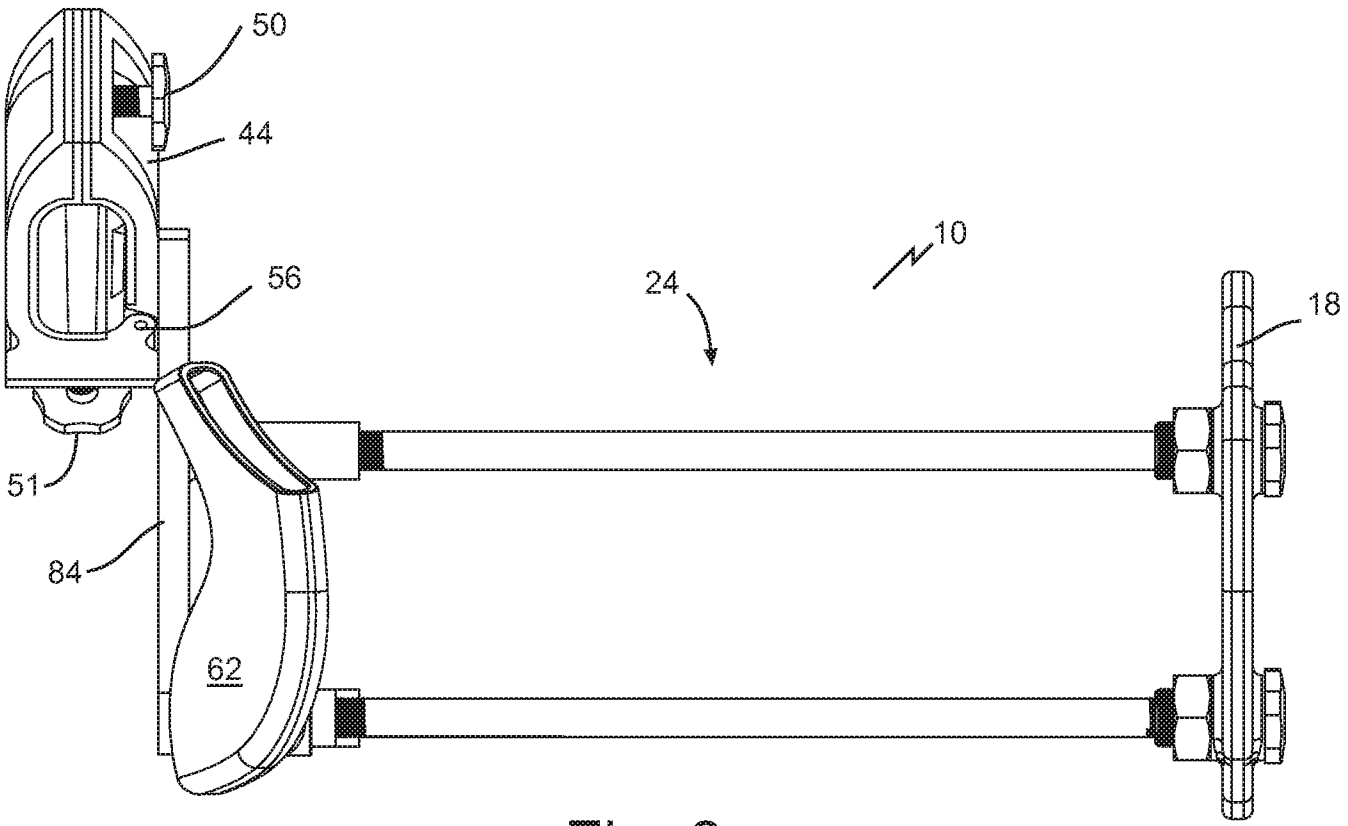
FIG. 8 is a front end view of the stickhandling tool of FIG. 6.
Figure 9:
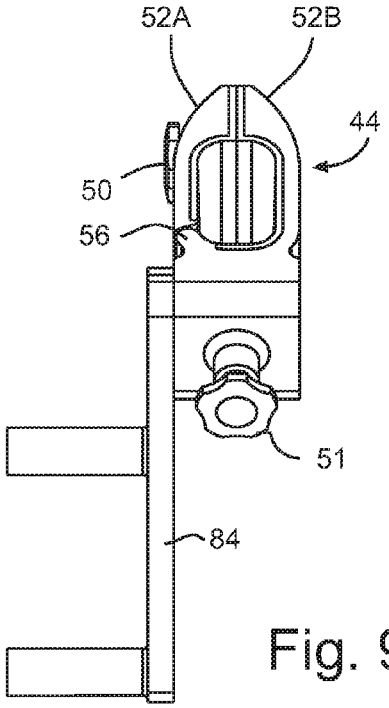
FIG. 9 is rear end view of a collar and support bar of the stickhandling tool of FIG. 6.
Figure 10:
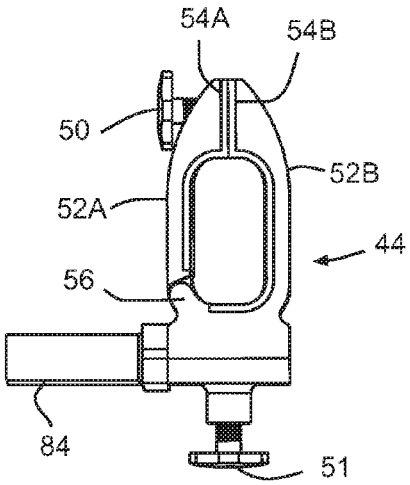
FIG. 10 is an elevation view of the collar and support bar of FIG. 9, viewing down the shaft axis defined by the collar.

Referring to FIGS. 6-8, an embodiment of stickhandling tool 10 is depicted wherein the shaft, heel, or ankle connector 42 comprises a clamp 44. In the example shown, during use clamp 44 secures the structural part 24 to the shaft 14 of the hockey stick 12. Referring to FIGS. 9 and 10, clamp 44 may comprise first and second jaw parts 52A and 52B and a fastening mechanism such as a bolt 50 as shown. The jaw parts 52A and 52B may be connected to pivot relative to one another, or to slide as shown. The user may open clamp 44 by loosening bolt 50 and separating the first and second jaw parts 52A and 52B from each other via a hinge 56. The user may then insert the hockey stick 12 between the first and second jaw parts 52A and 52B. Referring to FIG. 10, clamp 44 may also comprise compressible clamping pads 54A and 54B adapted for a non-damaging gripping contact against the shaft 14 of the hockey stick 12. Referring to FIG. 11A, the user may close the first and second jaw parts 52A, 52B and tighten bolt 50 to secure structural part 24 to the shaft 14 of hockey stick 12. Clamping pads 54A, 54B may be comprised of any suitable elastomeric or flexible or resilient material, such as rubber. The clamp 44 may be rotated in some cases to connect to a left or right handed stick 12.

Figure 11:
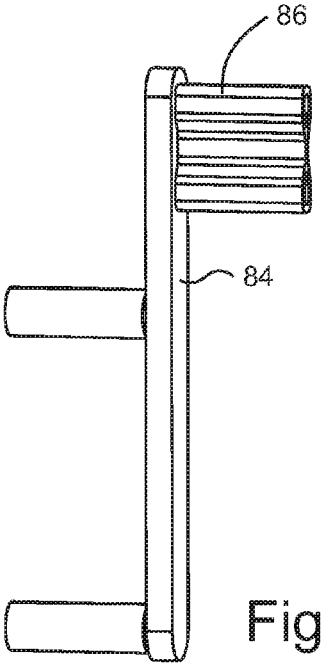
FIG. 11 is a perspective view of the support bar of FIG. 9.
Figure 11A:
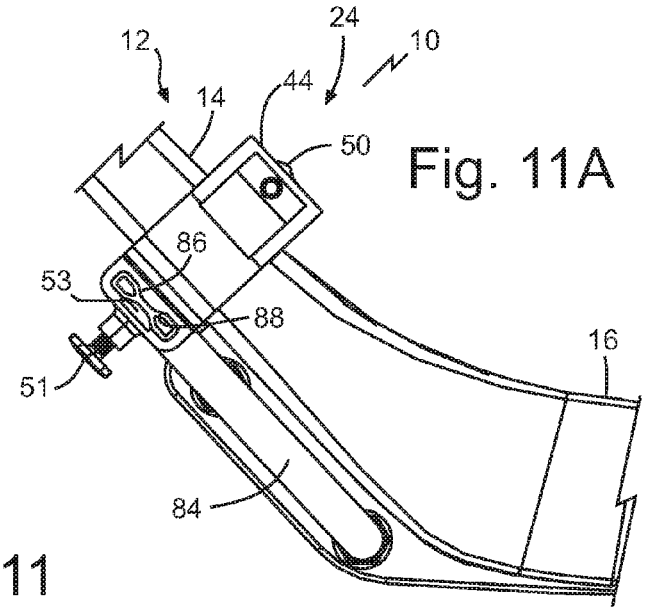
FIG. 11A is a side elevation view of the stickhandling tool of FIG. 6 attached to a hockey stick.

Referring to FIGS. 6-11, structural part 24 may also comprise a support bar 84, which mounts plural cross members, in this case members 28 and 30. Support bar 84 may depend from clamp 44 to provide part of a rigid frame that includes members 28 and 30. Referring to FIGS. 11 and 11A, support bar 84 may connect to the clamp 44 via a lateral bar or key 86 that inserts into a keyhole 88 defined by clamp 44. Support bar 84 may be secured to the clamp 44 via a fastener such as a bolt 51, which acts on a compressible pad 53 to contact the key 86. Tightening bolt 51 pushes the compressible pad 53 against key 86 to grip the bar 84 and restrict lateral movement of support bar 84. Referring to FIGS. 6 and 7, support bar 84 may connect to the second cross member 28 and third cross member 30 via a threaded or other suitable connection.

Figure 12:
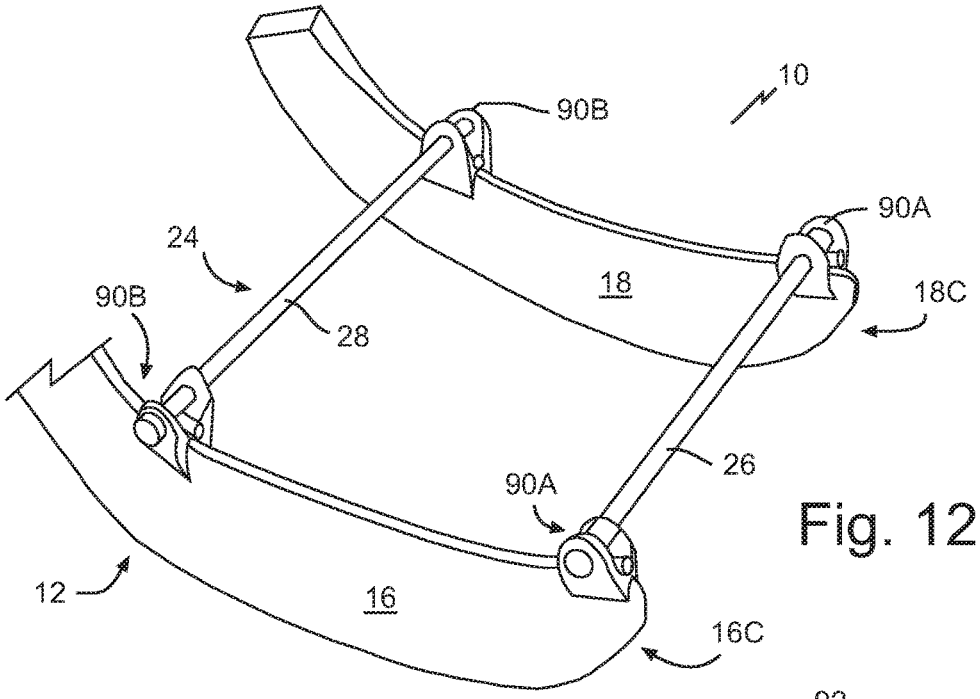
FIG. 12 is a perspective view of a further embodiment of a stickhandling tool with blade gripping members.
Figure 12A:
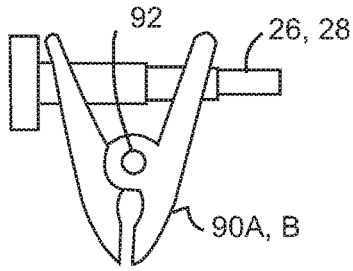
FIG. 12A is a side elevation view of a gripping member from FIG. 12.

Referring to FIG. 12, an embodiment of stickhandling tool 10 is depicted incorporating a structural part 24 that grips the blades 16 and 18, for example using a first and second gripping part 90A and 90B. First gripping parts 90A are depicted as clamps that secure the first cross member 26 to an upper edge of the toe parts 16C, 18C of the first and second blade 16 and 18, respectively. Second gripping parts 90B are depicted as clamps that secure the second cross member 28 to the heel or ankle parts 16E, 18E, or 16F, 18F, of blades 16 and 18, respectively. Referring to FIG. 12A, first and second gripping parts 90A and 90B may each comprise a bias member such as a torsion spring loaded hinge 92 for biasing the parts 90A, B closed. The embodiment of FIG. 12 illustrates an example of a structural part 24 that can be secured to conventional hockey stick blades. Gripping parts 90A and 90B may comprise any suitable gripping mechanism such as clamps or clips.

Figure 13:
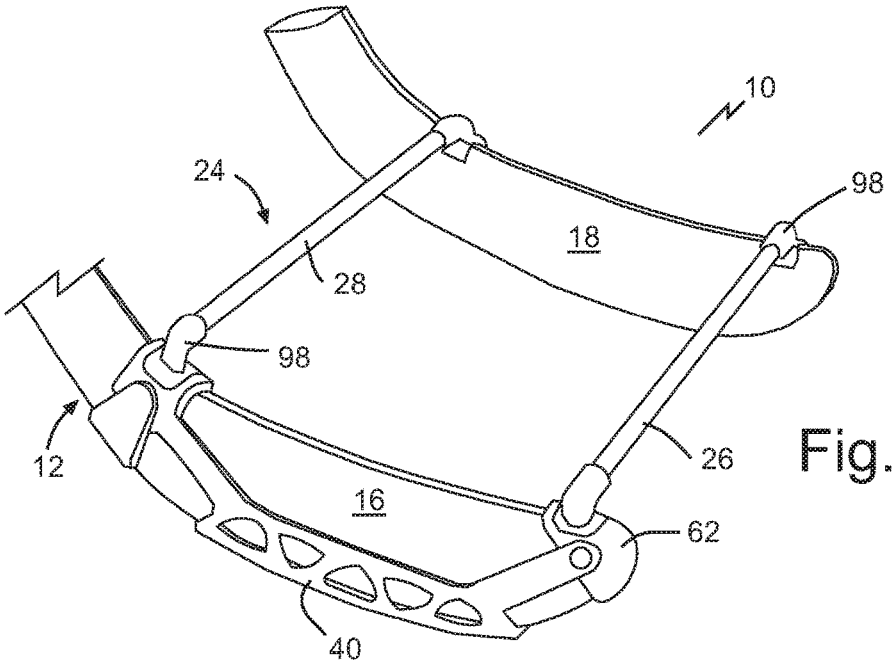
FIG. 13 is a perspective view of a further embodiment of a stickhandling tool.
Figure 14:
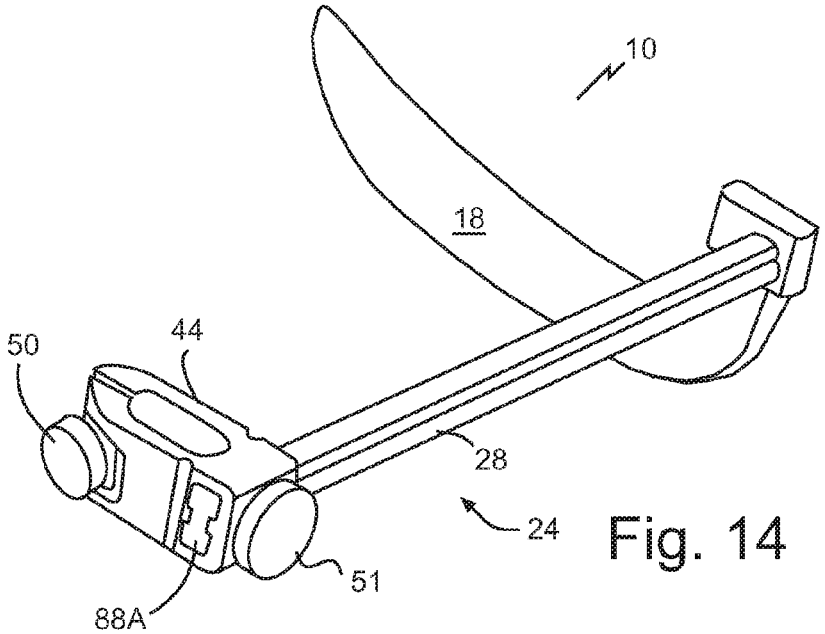
FIG. 14 is a perspective view of a further embodiment of a stickhandling tool with a collar and sliding cross member for providing variable width of a puck receiving cavity between the blades.
Figure 15:
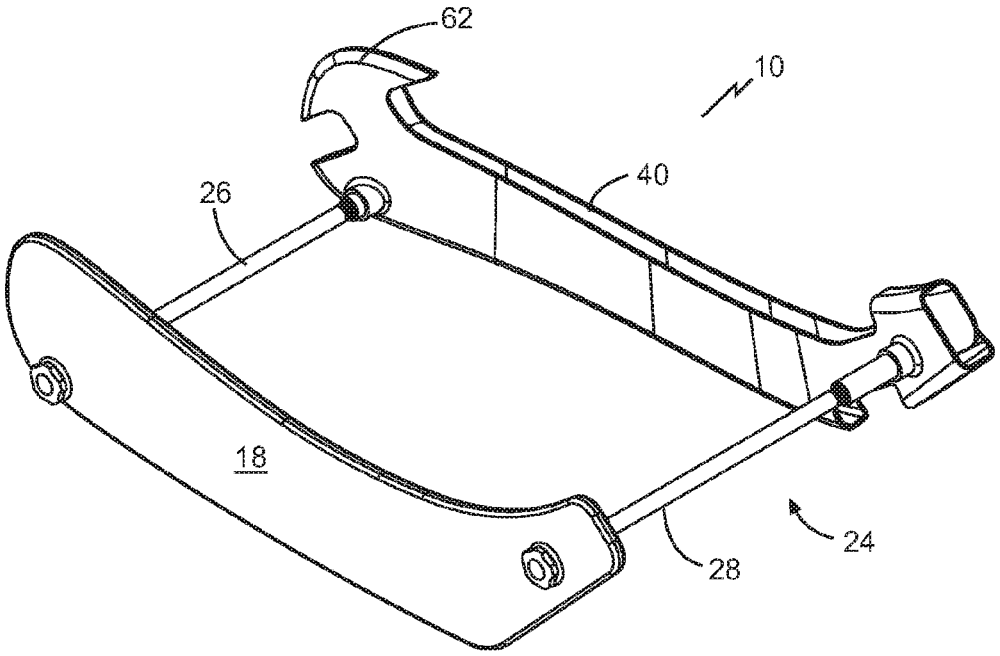
FIG. 15 is a perspective view of a further embodiment of a stickhandling tool with a blade retainer and two cross members.

Referring to FIG. 13, a further embodiment of stickhandling tool 10 is depicted with a structural part 24 comprising cross members 26, 28. In this embodiment, cross members 26 and 28 connect to blade retainer 40 and blades 16 and 18 via elbow connectors 98. Referring to FIG. 14, as disclosed above, an example is shown of a tool 10 that may be configured for right or left-handed use. Stickhandling tool 10 may comprise a clamp 44 with a sliding connection to cross member 28, for example formed by a keyhole 88A open on both ends and shaped to permit a corresponding second cross member 28 to slide within and be secured at a desired position to provide a desired lateral separation distance 97 (FIG. 5) via a suitable fastener such as bolt 51. FIG. 12 is another example of an embodiment that can be configured on a right or left handed blade 16. Referring to FIG. 15, an embodiment of stickhandling tool 10 is illustrated with dual cross members 26 and 28.

Figure 16:
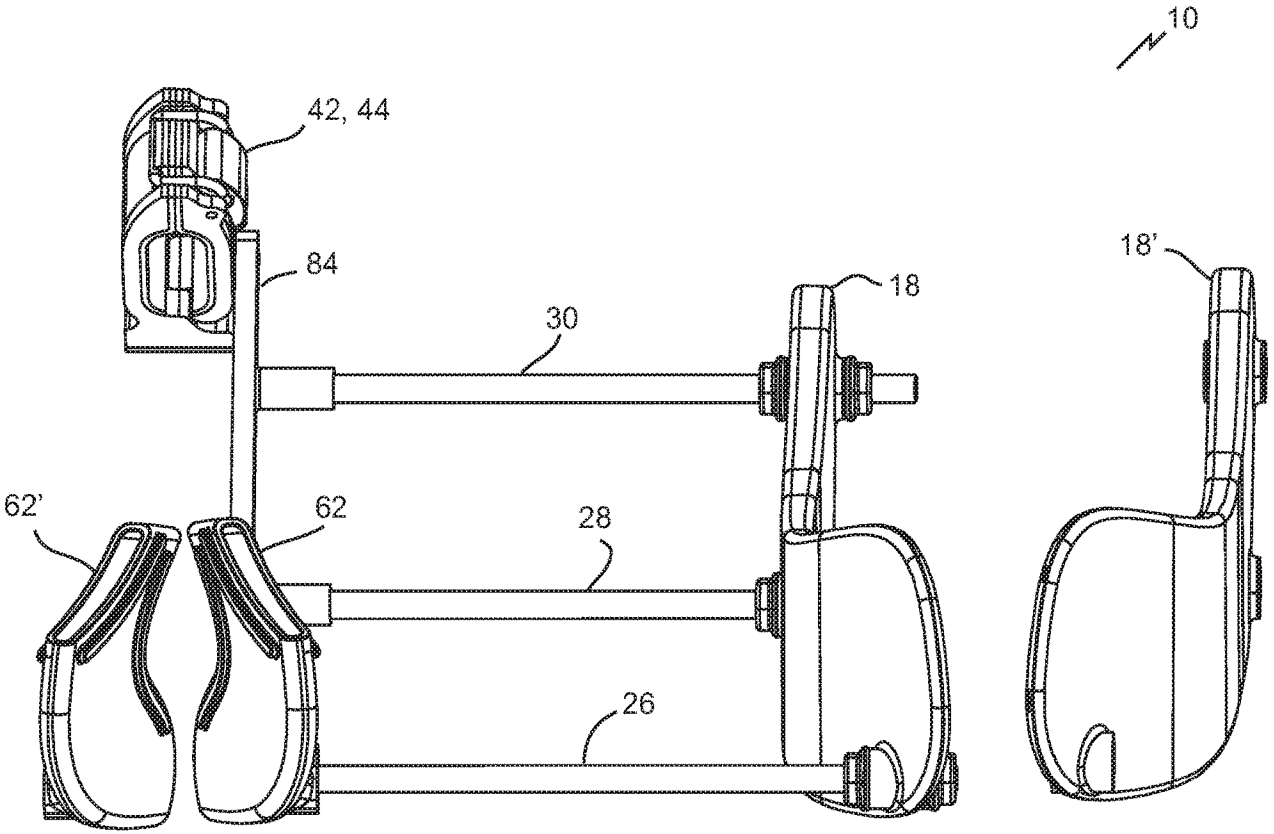
FIG. 16 is a front end view of another embodiment of a kit for a stickhandling tool with plural blades and plural toe receiving cups configured for left- and right-handed users.

Referring to FIG. 16, another embodiment of a kit 80 for a stickhandling tool 10 is depicted with left and right-handed second blades 18, 18' and left and right-handed toe receiving cups 62 and 62'. The kit 80 may be configured for a right or left-handed user by connecting a respective second blade 18 or 18' with a respective toe receiving cup 62 or 62' via structural cross members 26, 28, 30 and support bar 84. A user may change the configuration of tool 10 from left to right or right to left as follows. The structural cross members 26, 28, 30 may be disconnected from the second blade part 18, toe receiving cup 62 and support bar 84. The support bar 84 may be disconnected from the shaft, heel, or ankle connector 42. The support bar 84 may then be connected to extend out of the opposite side of connector 42 and cross members 26, 28, 30 may be reconnected with second blade 18' and toe receiving cup 62'. In another case, a user may select one of the two configurations and assemble the tool 10 in the desired configuration.

Figure 16A:
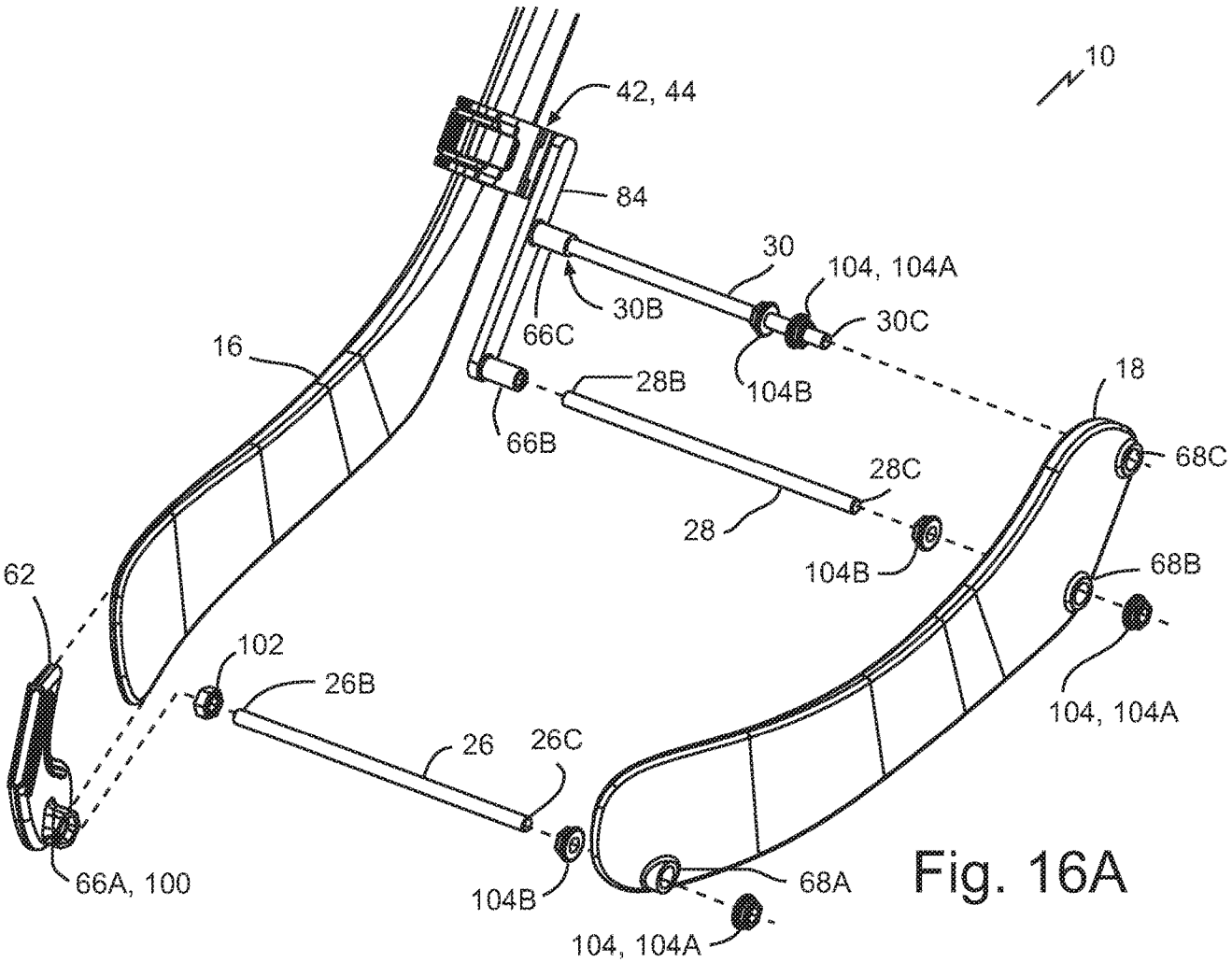
FIG. 16A is an exploded perspective view of one configuration of the stickhandling tool of FIG. 16.

Referring to FIG. 16A, a suitable mechanism of securing cross members 26, 28, and 30 between blades 16 and 18, for example to the support bar 84, is depicted. Cross members 26, 28, 30 may be adapted to mate with respective threaded female connectors 66A, 66B and 66C via first threaded ends 26B, 28B and 30B. Threaded female connector 66A may comprise a socket 100 adapted to receive first threaded end 26B and nut 102 that both thread to cross member 26. Second threaded ends 26C, 28C and 30C may be adapted to pass through, and in some cases threadably engage, respective cross member passages 68A, 68B, 68C and may be secured to second blade 18 via a plurality of nuts, such as crown or flanged nuts 104. There may be a respective pair of flanged nuts 104A and 104B flanking each of cross member passages 68A, 68B, 68C to secure the respective cross member 26, 28, 30 to second blade 18. In some cases the threading (not shown) on either or both ends of each cross member may be extended along a portion or the entire axial length of the cross member to permit the lateral separation distance between the blades to be tailored depending on how far up the cross members the second blade is positioned and secured via nuts 104.

Figure 17:
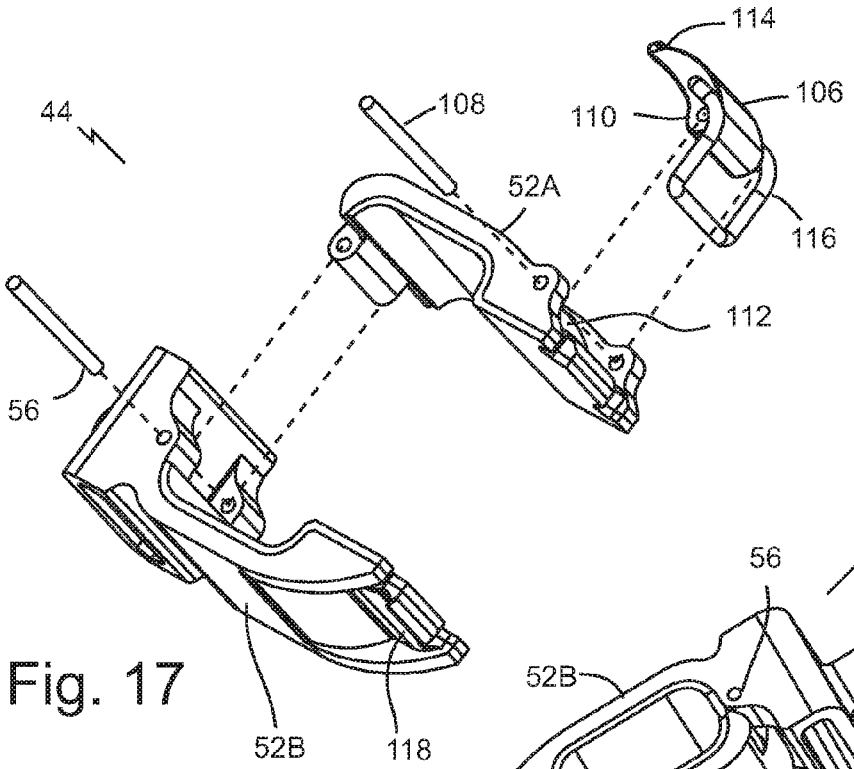
FIG. 17 is an exploded perspective view of the connector part of the stickhandling tool of FIG. 16 that connects to the shaft of a hockey stick.
Figure 18:
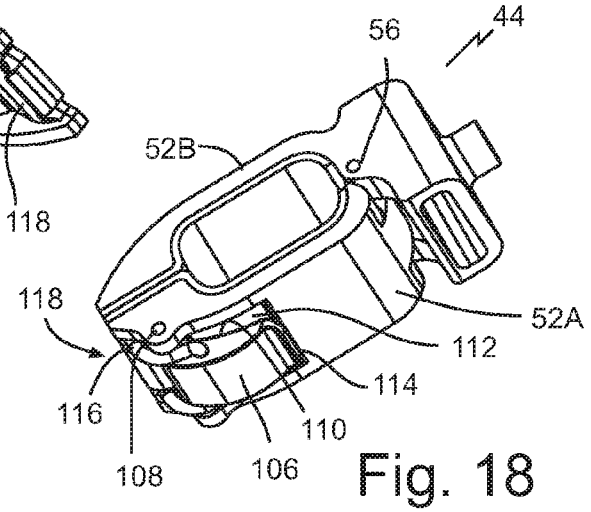
FIG. 18 is a perspective view of the connector part of FIG. 17 in the closed position.
Figure 19:
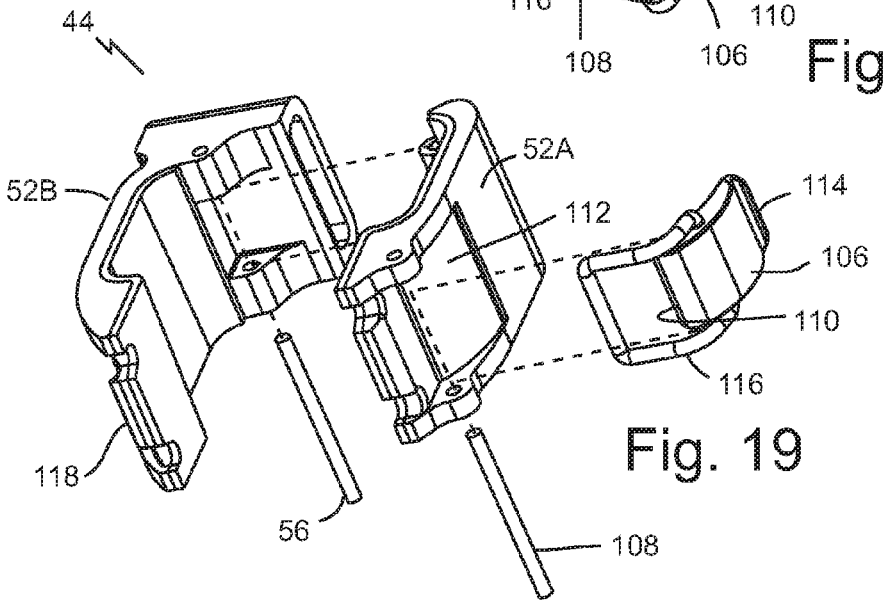
FIG. 19 is a further exploded perspective view of the connector part of FIG. 17.

Referring to FIGS. 17, 18 and 19, a suitable embodiment of clamp 44 is depicted. Clamp 44 may comprise an over-the-center latch to secure the first jaw 52A to the second jaw part 52B. The latch may comprise a wire or loop 116 and a camlock 106. The camlock 106 may be pivotally connected to first jaw 52A via a suitable hinge such as an axle 108. Camlock 106 may be closed by first engaging loop 116 around a hook 118 on second jaw 52B. The camlock 106 may then be rotated about axle 108 to cause cam surface 110 of camlock 106 to advance the camlock 106 along a corresponding ramp surface 112 of first jaw 52A. As the camlock 106 advances, tension is applied to loop 116 to compress the first and second jaws 52A, 52B together to grip the stick. Camlock 106 may be opened by swinging lip 114 away from first jaw 52A about axle 108 to retreat cam surface 110 along ramp surface 112, and release loop 116 from engagement with hook 118, allowing jaws 52A and 52B to be moved apart via axle 56.

The second blade 18 is depicted as straight but may also be curved in appearance (FIG. 16). The first blade 16 may be curved as shown or straight. The shaft, heel, or ankle connector 42 may also be a shaft, heel and ankle connector 42. The fences may be adjusted and in some cases removed for example to add difficulty as a user advances. A user may start with a full front and rear fence, and then remove the front fence, then the rear fence, or vice versa. In some cases cross members may be raised to effectively remove a fence effect. A part that is connected to one part, such as a toe, may be considered to mount proximal the toe, and distal other parts such as a heel. Parts may be connected via suitable mechanisms or fasteners, including bolts, rivets, screws, adhesive, camlock, hook and loop fasteners, and others. One, two or more cross members may be present.

The mechanisms described to connect or mount to the first blade 16 may be used to connect or mount to the second blade 18 in some cases. The first blade 16 and second blade 18 may form parts of first and second hockey sticks. The second blade 18 may be formed by a blade designed for connection to a shaft, such as a wood blade with a shaft connector or stub for insertion into a respective hollow aluminum shaft. Heel or ankle parts may be located adjacent or at heel or ankle ends 16G, 18G of blades 16, 18, respectively. Connector 44 may be a toe part connector, for example if the part 24 comprises only a toe to toe connector between blades 16 and 18. The tool 10 may be adapted to fit blades 16 of various sizes, for example by providing retainer 40 made of resilient or flexible elastomeric material. Front, rear, left, right, up and down, and other relative terms are not to be construed as absolute terms defined with respect to the surface of the earth unless context dictates otherwise.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A stickhandling tool comprising:

a hockey stick having a first hockey stick blade;

a second hockey stick blade;

a structural part comprising a first cross member and a second cross member that connect to the hockey stick and laterally separate the first hockey stick blade and the second hockey stick blade to define a ball or puck receiving cavity between the first hockey stick blade and the second hockey stick blade;

in which the structural part comprises a clamp, and the second cross member connects to the hockey stick by the clamp connecting the second cross member to a shaft of the hockey stick, a heel part of the first hockey stick blade, or an ankle part of the of the first hockey stick blade;

in which the structural part further comprises a toe receiving cup that receives, and connects the first cross member to, a toe part of the first hockey stick blade; and in which the first cross member extends between respective toe parts of the first hockey stick blade and the second hockey stick blade, and the second cross member extends between respective heel or ankle parts of the first hockey stick blade and the second hockey stick blade.

2. The stickhandling tool of claim 1 in which the clamp comprises a collar encircling the shaft of the hockey stick.

3. The stickhandling tool of claim 2 in which the clamp comprises a camlock.

4. The stickhandling tool of claim 1 in which the structural part forms a blade retainer that extends between the toe part and the heel part of the first hockey stick blade.

5. The stickhandling tool of claim 1 in which the second cross member forms a ball or puck fence that defines a heel end of the ball or puck receiving cavity.

6. The stickhandling tool of claim 5 in which:

both the first hockey stick blade and the second hockey stick blade define lower ice-contacting edges that extend continuously between respective toe and heel ends of the first hockey stick blade and the second hockey stick blade;

the first cross member forms a front ball or puck fence that defines a toe end of the ball or puck receiving cavity; and the second cross member forms a rear ball or puck fence that defines a heel end of the ball or puck receiving cavity.

7. The stickhandling tool of claim 1 further comprising a third cross member extended between respective heel or ankle parts of the first hockey stick blade and the second hockey stick blade.

8. The stickhandling tool of claim 1 in which the first cross member and the second cross member each comprise a lateral rod.

9. The stickhandling tool of claim 1 in which the first cross member and the second cross member are connected to the first hockey stick blade and the second hockey stick blade by respective threaded connections.

10. The stickhandling tool of claim 1 in which the structural part further comprises a connector that is adapted to permit the second hockey stick blade to be secured:

on a right side of the first hockey stick blade in a first configuration; and on a left side of the first hockey stick blade in a second configuration.

11. A kit comprising: a hockey stick blade;

a structural part comprising a clamp, a first cross member, a second cross member, and a toe receiving cup:

the clamp being structured to form a hockey stick shaft connector, or a hockey stick blade heel connector, or a hockey stick blade ankle connector;

the toe receiving cup structured to in use receive, and connect the first cross member to, a toe part of a blade of a hockey stick;

the first cross member structured while in use to extend between respective toe parts of the blade of the hockey stick and the hockey stick: and the second cross member structured to extend between the clamp and a heel or ankle part of the hockey stick blade while in use when the clamp connects the hockey stick blade to the hockey stick, laterally separate the hockey stick blade from the blade of the hockey stick to define a ball or puck receiving cavity between the hockey stick blade and the blade of the hockey stick.

12. The kit of claim 11 in which the first cross member and the second cross member each comprise a series of interchangeable cross members of different lengths with respect to one another for varying a lateral width of the ball or puck receiving cavity.

13. The stickhandling tool of claim 1 in which the structural part is structured to vary a lateral separation distance between the first hockey stick blade and the second hockey stick blade.

14. The stickhandling tool of claim 12 in which the structural part is structured to vary a lateral separation distance between the first hockey stick blade and the second hockey stick blade.

15. A stickhandling tool comprising:

a hockey stick having a first hockey stick blade;

a second hockey stick blade;

a structural part comprising a first cross member and a second cross member that connect to the hockey stick and laterally separate the first hockey stick blade and the second hockey stick blade to define a ball or puck receiving cavity between the first hockey stick blade and the second hockey stick blade;

in which the structural part comprises a toe connector that connects the first cross member to a toe part of the first hockey stick blade, with the first cross member extending between respective toe parts of the first hockey stick blade and the second hockey stick blade; and in which the structural part comprises a clamp that forms a collar that encircles the shaft of the hockey stick, with the second cross member connecting to the hockey stick by the clamp and extending between respective heel or ankle parts of the first hockey stick blade and the second hockey stick blade.

* * * * *